United States Patent [19]

Daley et al.

[11] 4,452,453

[45] Jun. 5, 1984

[54] BASEBALL BOARD GAME APPARATUS

[76] Inventors: James A. Daley, 121-1/2 N. Wabash, Glendora, Calif. 91740; Gregory J. Dore, 205 W. 3rd St., San Dimas, Calif. 91773

[21] Appl. No.: 320,664

[22] Filed: Nov. 12, 1981

[51] Int. Cl.[3] ..... A63F 7/00; A63F 3/00

[52] U.S. Cl. ..... 273/93 R

[58] Field of Search ..... 273/93 R, 244, 259, 273/243, 277

[56] References Cited

U.S. PATENT DOCUMENTS

| | | | |
|---|---|---|---|
| 1,349,615 | 8/1920 | Koellhoffer | 273/244 X |
| 1,458,275 | 6/1923 | Cossitt | 273/93 R |
| 3,368,813 | 2/1968 | McGraw | 273/93 R |

*Primary Examiner*—George J. Marlo

*Attorney, Agent, or Firm*—Boniard I. Brown

[57] ABSTRACT

A game board apparatus for symbolically representing the play of a baseball game for two players. The board has rectangular coordinates disposed thereon with indicia identifying rows and columns. A baseball field is superimposed on said indicia. A plurality of movable team member figures representing members of each team and a ball figure is provided and dimensioned for placement on the board. A first cubic die is thrown for determining if a team member at bat takes a ball or makes either a strike or a hit. A second cubic die is thrown to determine whether a hit is a fly, grounder, or bunt. A set of six regular dodecahedron dice are provided which each have their sides numbered 1 through 12. Three are coded to the columns, and three are coded to the rows. Up to six are thrown for a fly, four for a grounder and two for a bunt. When thrown after a hit, the numbers on each similarly coded die are combined to define the row and column coordinates away from home plate which is (0,0) to which the ball is hit. Thereafter, the alternate throwing of one regular dodecahedron dice by each player is used to determine the number of squares the fielders, runners or the ball can move on each turn.

9 Claims, 12 Drawing Figures

BASEBALL BOARD GAME APPARATUS

BACKGROUND OF THE INVENTION

The invention relates to board games and particularly to a board game representing the game of baseball.

An object of the invention is to provide a game which follows the general concept of the conventional baseball game as nearly as is practical.

It is another object of the invention to provide a game which is challenging and interesting to the players.

SUMMARY OF THE INVENTION

The foregoing objects and other objects and advantages which shall become apparent from the detailed description of the preferred embodiment are attained in a game board apparatus for symbolically representing the play of a baseball game for two players which each have a team. The board has rectangular coordinates disposed thereon and indicia identifying rows and columns. The baseball diamond is superimposed on said indicia defining said rows and columns and said apparatus further includes a plurality of team member symbols representing the members of each players team, each team member symbol is dimensioned for placement at a plurality of positions on said board. The apparatus further includes a ball symbol dimensioned for placement at a plurality of positions on the board defined by the intersection of the rows and columns. A first means for substantially randomly determining if a team member makes either a strike, ball or hit, for the purpose of advancing team members around the baseball diamond. A second means for substantially randomly determining if a player does make a hit, whether it is a fly, grounder or bunt.

In one form of the invention the first means comprises a first die and the second means comprises a second die. The third means may comprise three pair of polyhedrons, each having indicia marked thereon corresponding respectively to the indicia disposed on the board which identifies the rows and columns.

At least some of the team members may be configured to represent a runner.

The indicia on the board may include indicia identifying the rows and columns which are disposed respectively on first and second adjacent sides of the board. The polyhedrons have faces which are generally planar and which on any one polyhedron are substantially identical.

BRIEF DESCRIPTION OF THE ACCOMPANYING DRAWING

Figure 1:
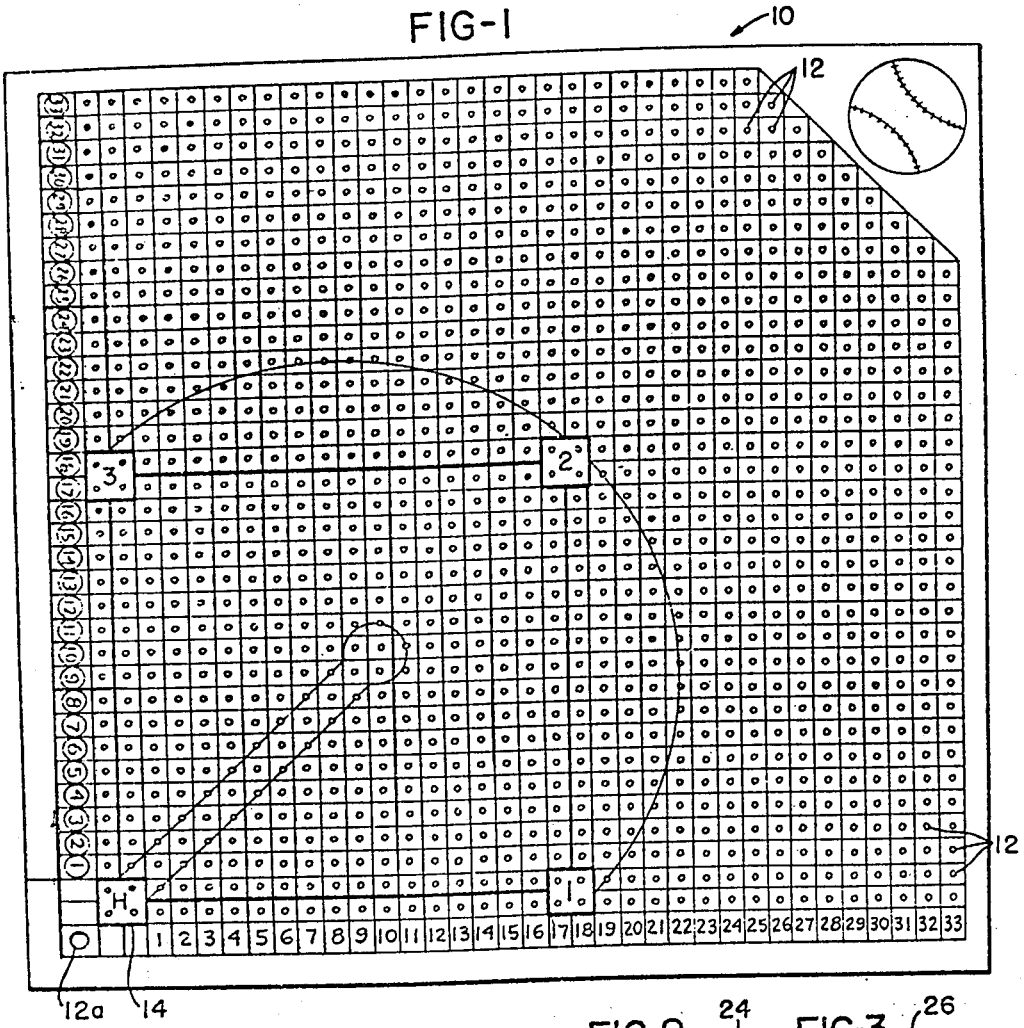
FIG. 1 is a plan view of a game board in accordance with the invention.
Figure 2:
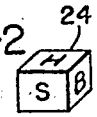
FIGS. 2 and 3 are perspective views of dice identified as pitching dice.
Figure 3:
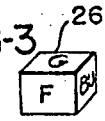
Figure 4:
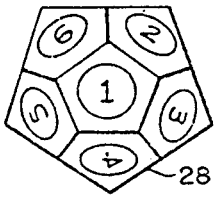
Figure 5:
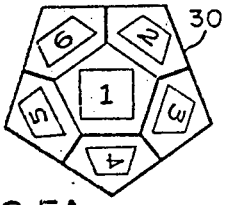
Figure 7:
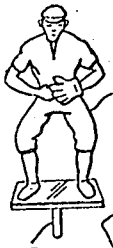
Figure 2A:
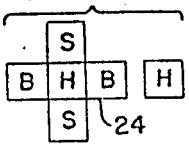
Figure 3A:
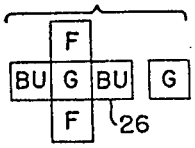
Figure 4A:
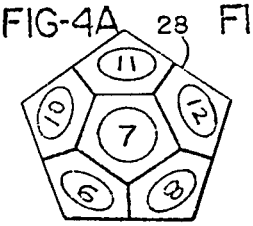
Figure 5A:
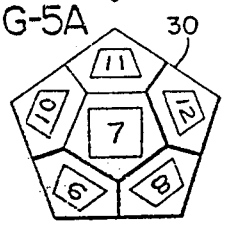
Figure 8:
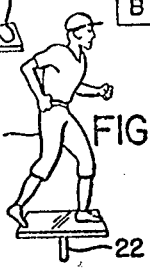
Figure 6:
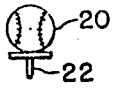

FIGS. 2*a* and 3*a* are respectively developed views of the dice illustrated respectively in FIGS. 2 and 3, and which illustrate the six discrete faces of the dice;

FIGS. 4 and 5 are respectively top views of dies identified as placing dies herein;

FIGS. 4*a* and 5*a* are respectively bottom views of the dies illustrated in FIGS. 4 and 5;

FIG. 6 is an elevational view of a symbol or token which represents a baseball;

FIG. 7 is a perspective view of a symbol or token representative of either an infielder or an outfielder; and FIG. 8 is a perspective view of a symbol or token representative of a base runner.

DESCRIPTION OF THE PREFERRED EMBODIMENT

Referring now to FIGS. 1–8, there is shown a board 10 which is ordinarily generally square and has a matrix array having; in the preferred form, 33 discrete rows and 33 discrete columns. Indicia is provided along the lower (as viewed) edge and the left (as viewed) edge. Within the arrangement of rows and columns is disposed a baseball diamond which includes positions corresponding to home plate 14 (identified by the legend "H") first, second, and third base (identified respectively by the numerals "1", "2", and "3"). In the conventional location a pitcher's mound is also defined. Each of the positions identified by the intersection of the numbered rows and columns is provided with a hole 12 which is suitable for receiving any of the symbols or tokens 16, 18 or 20, identified respectively in FIGS. 7, 8 and 6. Each of the symbols 16, 18 and 20 is provided with a peg 22 for cooperation with the holes 12 in the board 10.

The symbol 16 is intended to represent an infielder or an outfielder. The symbol 18 is intended to represent a base runner. The symbol 20 is, of course, intended to represent a baseball.

The playing apparatus further includes dice 24, 26. The die 24 is identified with indicia on the six faces thereof. The indicia in the preferred form includes the letters "B" on two sides, "S" on two sides, and "H" on two sides of the six sides thereof. The face opposite any such face will preferably have the same marking as is evident from FIGS. 2A and 3A. The letters are intended to refer to either a ball, "B"; strike "S"; or hit, "H".

The die 26 also has six faces and opposite faces are respectively identified with the indicia "F", "G", and BU. This indicia corresponds to the terms fly, grounder, and bunt. The various faces of the dice 24, 26 will be most apparent from the developed views of FIGS. 2*a* and 3*a*.

The game playing apparatus further includes three placing dies 28 and three placing dies 30. Each of the dies 28, 30 is a regular dodecahedron having twelve regular pentagon faces, that is each face has five equal sides as is apparent from FIGS. 4, 5, 4*a* and 5*a*. The numerals 1–12, are disposed on the twelve faces of each of the dies 28, 30 with one number on each face. In the preferred form, each numeral on each die 28 is disposed within a circle and each numeral on each die 30 is disposed within a square for coding as to columns and rows. In alternative forms of the invention, the dies 28 and 30 may be provided with other means for distinguishing them such as coloring the dies 28 a different color than dies 30.

The play is initiated by issuing to each of the two players a team of nine fielder symbols 16 and four base runner symbols 18. The game player whose team is not at bat locates three of the fielder symbols 16 at locations of his choice in the outfield corresponding to generally left field, center field, and right field. One of the fielder symbols 16 is placed in the hole 12*a* immediately behind the "H" or home base position 14. Another of the fielder symbols 16 is placed on the pitchers mound identified by the arcuate representation thereof intermediate the first and second bases. Other fielder symbols 16 are placed near the first, second and third bases, as well as one intermediate the second and third bases, to represent the short stop. One runner symbol 18 is positioned at the start square 14, which is also provided with a hole, although the symbols are initially located in the dugout (not shown).

The play is initiated by the pitching team rolling the die 24. Observation of the die 24, which is marked with two each of the symbols "S", "B", and "H", indicates whether a strike, a ball, or a hit has occurred. If three strikes are thrown, the batter is out and if four balls are thrown the batter "walks." if the "H" indicia on the die 24 comes out uppermost, as illustrated in FIG. 2 the die 26 will be observed to determine which face is uppermost. Once a symbolic hit is rolled and the kind of hit is determined by throwing the die 26, the placing dies 28 and 30 are thrown to determine where the ball 20 has landed. It will be observed that the indicia along the lower edge of the board 10 is each disposed within a rectangle. The indicia along the left edge of the board 10 is provided with a circle around each numeral. Each of the dies 28, 30 is provided with indicia which are similarly provided with corresponding circles and squares around the indicia on the faces thereof. The total numerals on the placing dice 28, 30 indicate in which row and column the ball 20 has landed.

Thereafter the batting team rolls one of the dice 28 or 30 with the numerals thereon determining the squares the runner symbol or symbols 18 are to be advanced. This is followed by the fielder rolling a die 28 or 30 to determine the advancement of a fielder to the ball symbol 20 and the advancement of the ball to a base. This alternate rolling continues throughout the play. In the second half of an inning, the players reverse roles. The batting team must try to move its runner symbols 18 to the bases before the pitching team can get the ball to that base to get the runner out. The pitching team must have a man and the ball on the base to get the runner out. For the pitching team to get the ball to any base they must roll, in their turn, the moving dice 28 or 30 and move one of their fielder symbols 18 to the square the ball is on. Then ball symbol 20 can be thrown by using the moving dice 28 or 30 to determine the amount of movement on each turn. Once ball symbol 20 has left a fielder symbol 18, it must reach the fielder symbol 18 it was thrown to before it can be thrown in another direction.

If a runner symbol 18 is approaching a base that is already occupied by another runner symbol 18, the runner already on the base must leave the base before the approaching runner can get on that base. If a runner symbol 18 reaches a base while ball symbol 20 is still in motion he can continue to run or call it safe on that base and thereby end the play.

Three strikes constitutes an out, as in the conventional game. After three outs the running team becomes the pitching team and the pitching team becomes the running team. When both teams have batted once, an inning is completed. The team with the most runs in five innings wins the game. To make runs the batting team must get runner symbols 18 around the base to home plate 14 without being out.

When a bunt is rolled, one of each of the twelve sided dice 28, 30 are rolld. Similarly when a grounder is rolled, at least one of each of the twelve sided dice 28, 30 are rolled. The player has the option of rolling two of either dice 28, 30 and one of the other. For instance, if you rolled a grounder, you can roll two circle indicia die 28 and one square indicia die 30 or vice versa.

When a fly is rolled three of each of twelve sided dies 28, 30 are rolled with the option of rolling three of one kind and one of another or three of one kind and two of another.

When a fly ball is rolled by a pitching team and thereafter the batting team rolls the placing dies 28 or 30 so as to position the ball 20 in which one of the pitching team players is disposed, it is automatically deemed that the fly ball is caught and an out is counted.

If the pitching team rolls the pitching dice 24, 26 and the die 24 rolls to a "B" position four successive times before a strike or a hit, there is an automatic walk to the first base for that runner. As in an actual game, if any player is already on first base he also will be advanced one base. If players are already on successive bases starting with the first base, then each of the runners must advance one base or be out.

EXAMPLES OF GAME PLAYS

First Example

Pitching team rolls the pitching dies 24, 26, one which designates a "H" or a hit, and the second dice designates "G" for grounder.

Next the batting side rolls the dies 28, 30 whose total numeric count define a particular coordinate position. The ball symbol 20 is positioned on the square of the playing board which corresponds to the coordinates designated along the edges thereof.

With the ball symbol 20 thus positioned and the game now in play, the placing dies 28, 30 become "moving dice", one of the dice being used by each team (the circles and squares about the numbers on the respective dice have no meaning after the ball is first positioned after being "hit" by the batting side). The batting team then rolls first, and moves its player a number of squares in accordance with the number rolled on its one die. The pitching team rolls its dice to either send a man to the ball symbol 20 or to touch the square where the ball symbol 20 is located. Once the player has touched that square, the player can choose his tactic, and throw the ball symbol 20 a number of squares determined by the number thereon in any direction—i.e., whichever base he chooses, preferably to that base "to get the runner out," or he can send the ball to a base ahead of where the runner will be. If the runner reaches the base first, he is safe and the ball symbol 20 is then removed from the board 10, and a new round of play is started with the new batter.

Second Example

The pitching side rolls the pitching dice 24, 26, and one die indicates "H" for hit, and the other designates "G" for a grounder. A player symbol (assumed to already be on first) must leave that base before a new batter can arrive safely on first base. The batting side rolls its playing dice 28 or 30 to move its runner symbol 18, and can choose either runner, or both, to move a total number of squares corresponding to the number rolled on the placing dice 28 or 30. The total number can be divided between two runners, or the total number can be used to move a single runner (as noted above, only one moving dice is used per playing side).

In the event that the runner symbol 18 moving from first base does not get to second base before the ball reaches second base, there is a forced out. A double play might be made, i.e., after the ball reaches second base, it can be moved to first base (if the appropriate number is rolled on the dice), and the ball symbol 20 may be moved to first base to beat the runner symbol 18 to first base, to effect a double play.

Further Play

Assume a runner symbol 18 is on third base. The pitching side rolls the pitching dice 24, 26 gets an "H" on one and a "G" on the other. The ball symbol 20 is moved to the designated square on the playing board 10 corresponding to the coordinates rolled on the placing dice 28 or 30 by the batting team. The batter now rolls his placing dies 28 or 30 and moves its runner symbol 18 in accordance with the number designated by the roll of the placing dice 28 or 30, about the bases. The runner symbol 18 moving from third reaches home plate 14, to score a run. He must reach home plate 14 before the other runner is out, if there are already two outs. If the numerals on the thrown dice 28 and 30 define a coordinate point off of the field, the batter has hit a home run.

The invention has been described with reference to its illustrated preferred embodiment. Persons skilled in the art may, upon exposure to the teachings herein, conceive variations in the development of the components therein. Such variations are deemed to be encompassed by the disclosure, the invention being delimited only by the appended claims.

The inventor claims:

1. Game board apparatus for symbolically representing the play of a baseball game for two players which each have a team and which comprises:

a board on which is disposed rectangular coordinates and indicia identifying rows and columns and a baseball field superimposed thereon, said baseball field thereon constituting a continuous course of play;

a plurality of team member symbols representing members of each player's team, each team member symbol being dimensioned for placement at a plurality of positions on said board;

a ball symbol dimensioned for placement at a plurality of positions on said board defined by the intersection of said rows and columns;

first means for determining one of three events, said first means having indicia of strike, ball, and hit thereon;

second means for determining one of three events after a hit indicia has appeared on said first means, said second means having, fly, grounder, and bunt indicia thereon;

third means for randomly, with center weighting, determining on which of said columns said ball symbol is to be placed after a fly indicia has appeared on said second means; and fourth means for randomly, with center weighting, determining on which of said rows said ball symbol is to be placed after a fly indicia has appeared on said second means.

2. The apparatus as described in claim 1 wherein:

said first means comprise a first cubic die having hit indicia on two sides thereof; and said second means comprise a second cubic die having fly indicia on two sides thereof.

3. The apparatus as described in claim 2 wherein said hit indicia are on opposite sides of said first cubic die, said first cubic die also including:

ball indicia on two opposite sides thereof; and strike indicia on two opposite sides thereof.

4. The apparatus as described in claim 2 wherein said fly indicia are on opposite sides of said second cubic die, said second cubic die also including:

grounder indicia on two opposite sides thereof; and bunt indicia on two opposite sides thereof.

5. The apparatus as described in claim 1, wherein:

said third means and fourth means comprise three regular dodecahedrons, each regular dodecahedron having numerical indicia marked thereon from 1 to 12.

6. The apparatus as described in claim 5, wherein:

at least some of said team member symbols are runner figures and at least some are fielder figures.

7. The apparatus as described in claim 6, wherein:

said numeric indicia on said board identifying said rows and columns is disposed on at least two adjacent sides of said board, said row numeric indicia and said column numeric indicia each being from 1 to less than 36.

8. The apparatus as described in claim 7 wherein said third means are color coded to said column numeric indicia and said fourth means are color coded to said row numeric indicia.

9. The apparatus as described in claim 7 where locations whose numerical coordinates totaled exceed 59 are not present on said super imposed baseball field.

* * * * *